United States Patent [19]

Morris, Sr.

[11] Patent Number: 4,967,926

[45] Date of Patent: Nov. 6, 1990

[54] CHILD-RESISTANT MOLDED PLASTIC CONTAINER LID FOR OPEN HEAD CONTAINERS

[76] Inventor: Glenn H. Morris, Sr., 1192 Cumberland Rd., Chattanooga, Tenn. 37419

[21] Appl. No.: 363,764

[22] Filed: Jun. 9, 1989

[51] Int. Cl.[5] ..... B65D 55/02; B65D 41/04

[52] U.S. Cl. ..... 220/323; 215/214; 215/DIG. 1; 220/288; 220/DIG. 6

[58] Field of Search ..... 220/288, 304, 323, DIG. 6; 215/214, DIG. 1

[56] References Cited

U.S. PATENT DOCUMENTS

| | | | |
|---|---|---|---|
| 3,275,180 | 9/1966 | Optner | 215/DIG. 1 |
| 3,425,589 | 2/1969 | Lipske | 220/304 |
| 4,027,777 | 6/1977 | Blanke | 215/DIG. 1 |
| 4,126,246 | 11/1978 | Galer | 220/304 |
| 4,298,132 | 11/1981 | Galer | 220/304 |
| 4,380,304 | 4/1983 | Anderson | 215/DIG. 1 |
| 4,399,926 | 8/1983 | Eidels-Dubovoy | 220/288 |
| 4,418,833 | 11/1983 | Landis | 215/DIG. 1 |
| 4,453,647 | 6/1984 | Neat | 220/288 |
| 4,732,288 | 3/1988 | Morris | 215/214 |

*Primary Examiner*—George E. Lowrance

*Attorney, Agent, or Firm*—Brady, O'Boyle & Gates

[57] ABSTRACT

A child-resistant molded plastic container lid for open head containers wherein a threaded connection is provided between the container and lid. The lid is provided with at least one and in certain instances with a pair of diametrically disposed resiliently biased locking members, pivotally connected to the closure, which cooperate with locking teeth on the container. The lever arms of the locking members are offset and substantially parallel to each other on opposite sides of the pivotal connection. An elliptical spring is integrally connected to each lever arm and cooperates with portions of a gusset wall enclosing the lever arm to provide continued biasing memory on the locking member. A seal arrangement is also provided between the lid and the container to provide a tight and rigid seal and to reinforce the top of the container and lid to prevent the lid from popping off the container when it is dropped while full of liquid or powder material.

26 Claims, 5 Drawing Sheets

FIG. 4
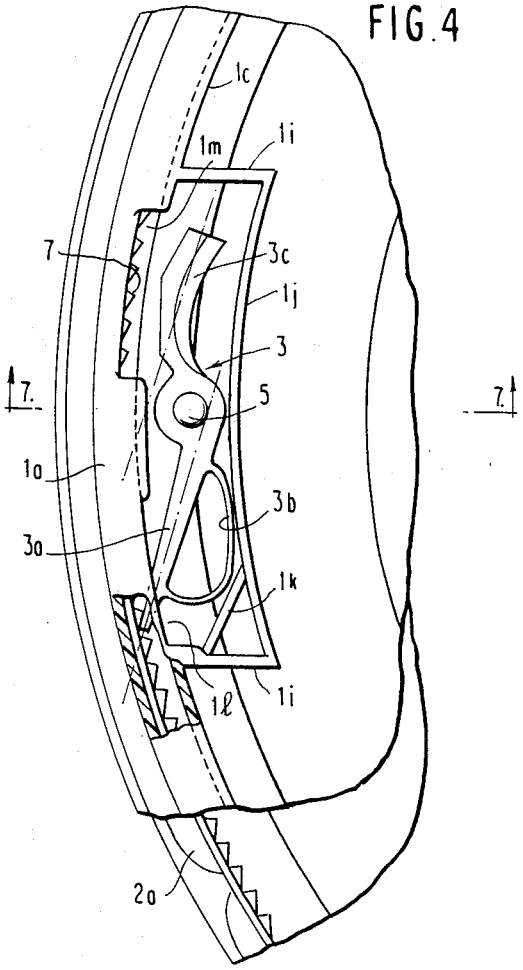
FIG. 5
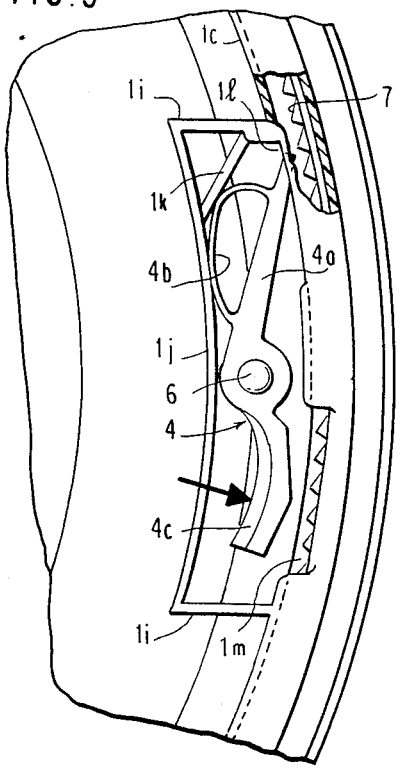
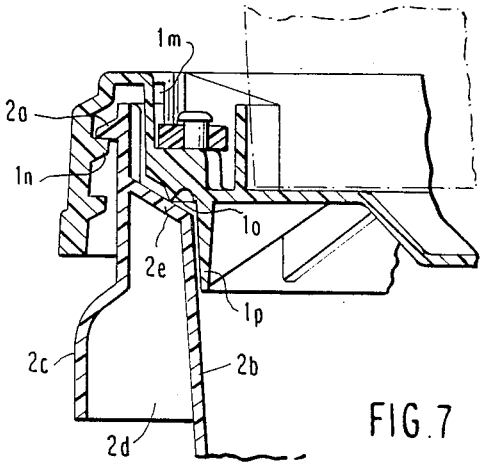
FIG. 7
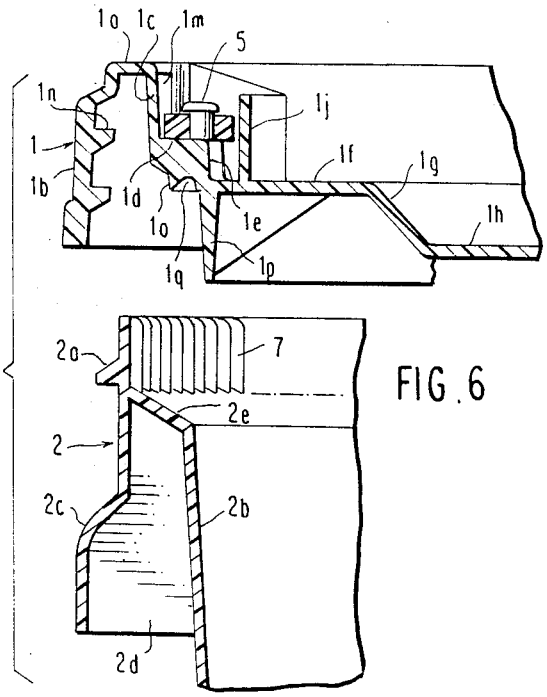
FIG. 6
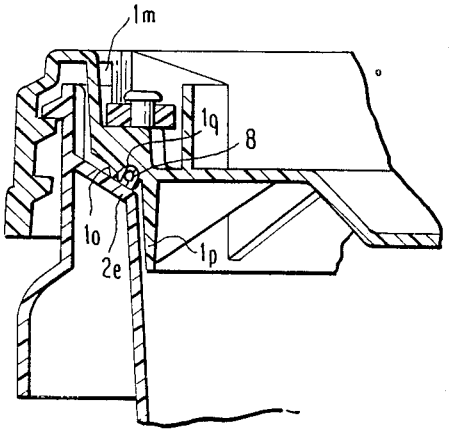
FIG. 8

CHILD-RESISTANT MOLDED PLASTIC CONTAINER LID FOR OPEN HEAD CONTAINERS

BACKGROUND OF THE INVENTION

The child-resistant molded plastic container lid for open head containers of the present invention is of the type disclosed in U.S. Pat. No. 4,732,288, dated Mar. 22, 1988, wherein a threaded connection is provided between the container and lid, and the lid is provided with at least one resiliently biased locking member, and in certain embodiments with a pair of diametrically disposed resiliently biased locking members, pivotally connected to the closure lid, which cooperate with locking teeth on the container.

In the continuing research and development to improve the child-resistant molded plastic container lid and open head container disclosed in my above-mentioned patent, the lid and container of the present invention have been devised wherein the lever arms of the locking members are offset and substantially parallel to each other on opposite sides of the pivotal connection. An elliptical spring is integrally connected to each lever arm and cooperates with portions of a gusset wall enclosing the lever arms to provide continued biasing memory on the locking member.

A pair of openings or cut-outs are provided in the side wall of the lid rim for accommodating a respective lever arm of the locking member, and a thumb engaging portion of the lever arm.

An improved seal arrangement is also provided between the lid and the container to provide a tight and rigid seal and to reinforce the top of the container and lid to prevent the lid from popping off the container when it is dropped while full of liquid or powder.

BRIEF DESCRIPTION OF THE DRAWINGS

FIG. 4 is a fragmentary, top elevational view showing one of the resiliently biased locking members engaging locking teeth on the container;

FIG. 5 is a fragmentary, top elevational view showing one of the resiliently biased locking members moved to the released position from the locking teeth on the container;

FIG. 6 is an exploded, fragmentary, sectional, side elevational view of the lid and container;

FIG. 7 is a view taken along line 7—7 of FIG. 4, showing one embodiment of a seal arrangement between the lid and container;

FIG. 8 is a fragmentary, sectional, side elevational view of the lid secured to the container showing another embodiment of a seal arrangement;

Figure 1:
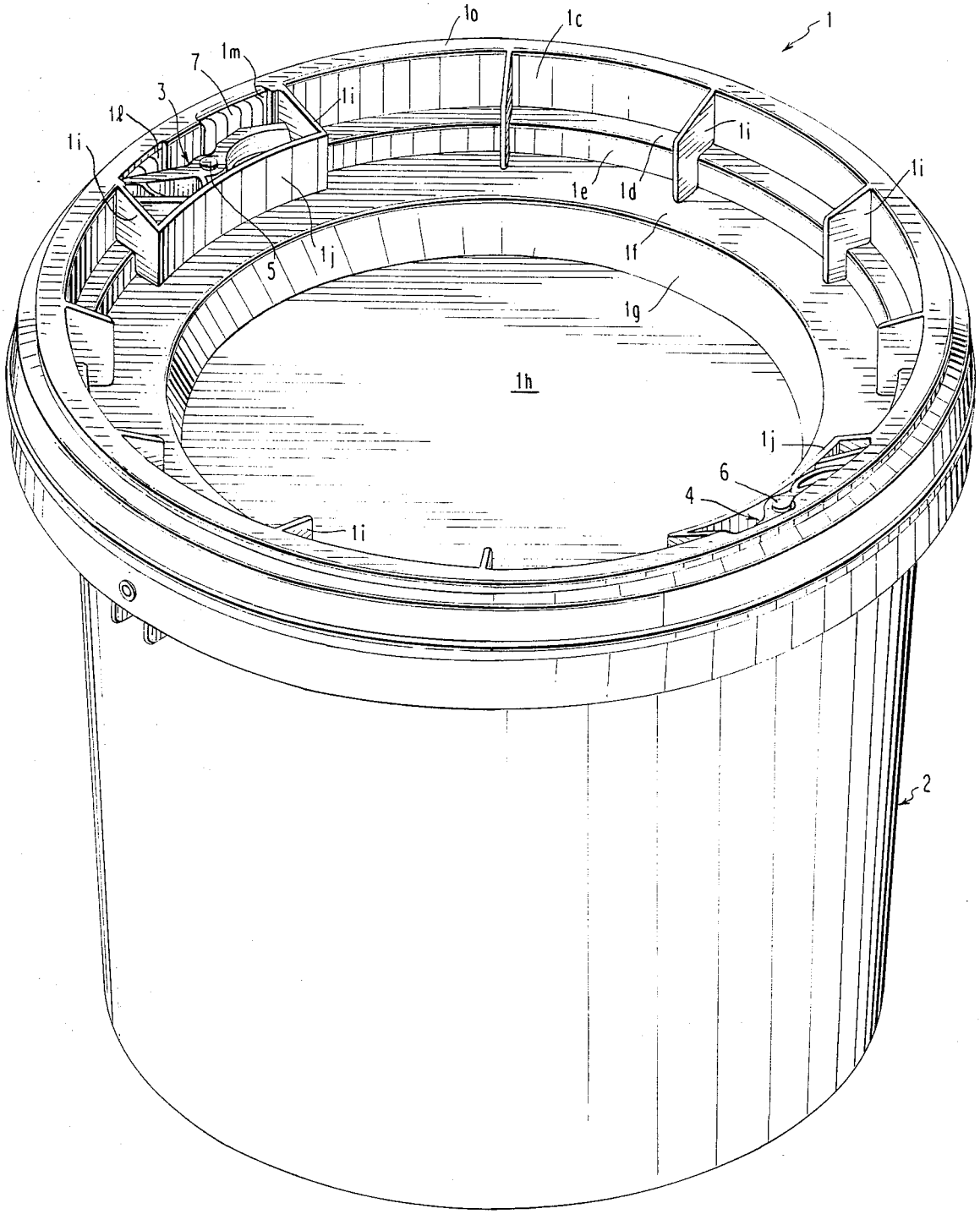
FIG. 1 is a perspective view of the lid and container of the present invention.
Figure 2:
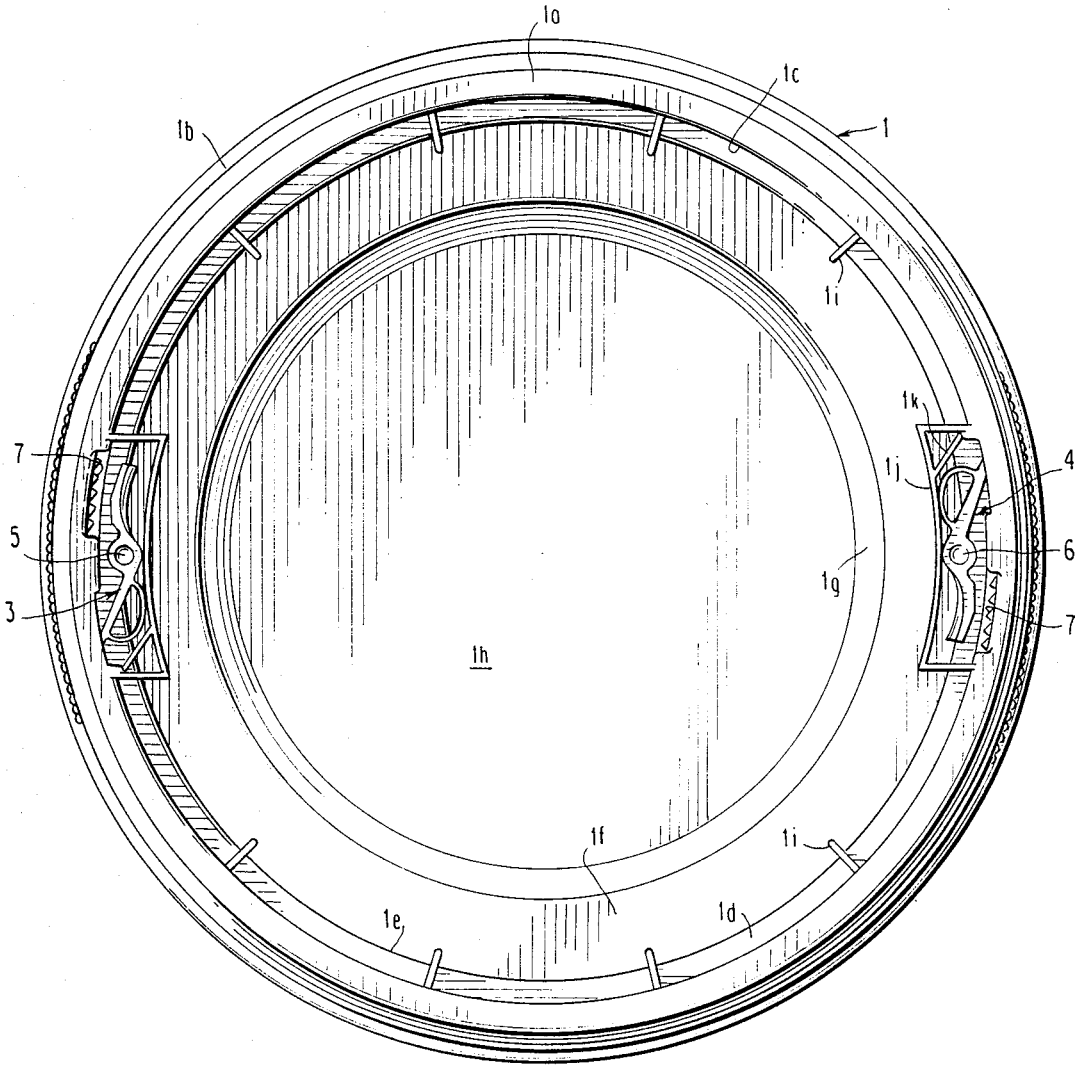
FIG. 2 is a top plan view of the lid and container shown in FIG. 1.
Figure 3:
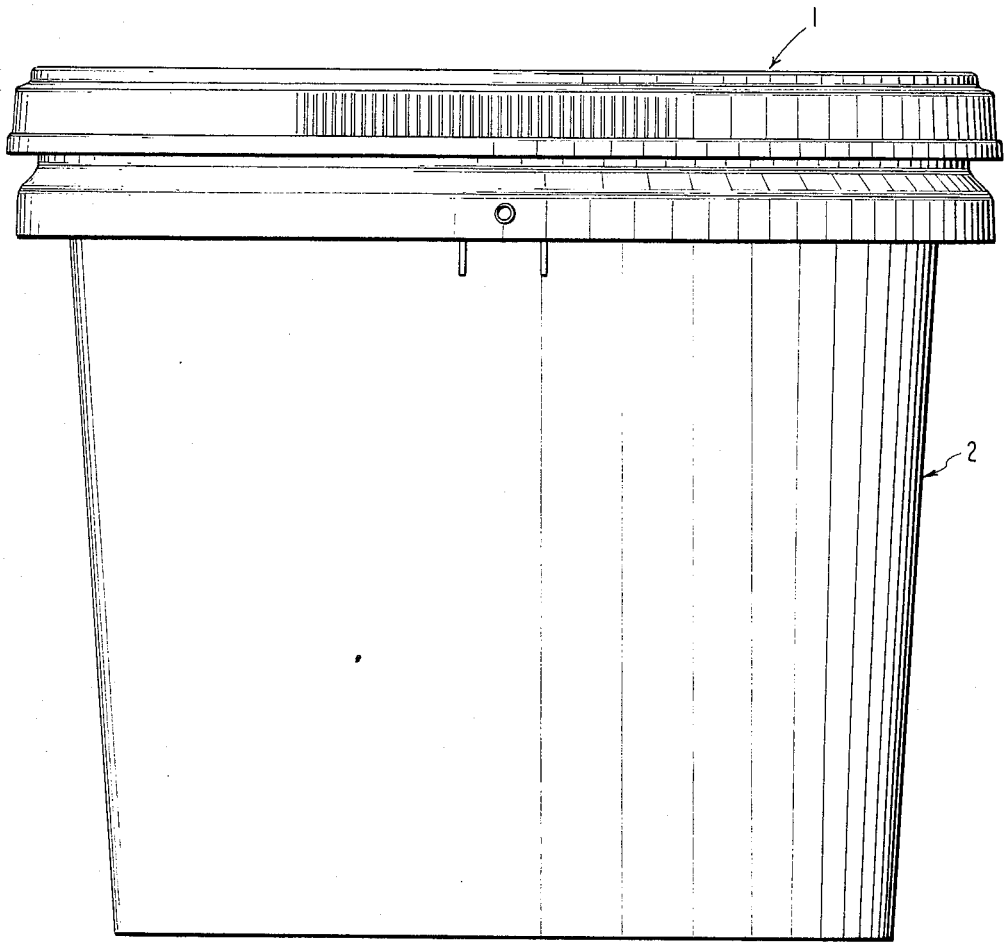
FIG. 3 is a side elevational view of the lid and container.

DESCRIPTION OF THE PREFERRED EMBODIMENTS:

Referring to the drawings and more particularly to FIGS. 1, 2 and 3, the child-resistant molded plastic container lid for open head containers of the present invention comprises a lid 1 threadably mounted on a container 2. A pair of diametrically disposed resiliently biased locking members 3 and 4 are each pivotally mounted to the lid as at 5 and 6, and cooperate with a plurality of teeth 7 on the container 2 for releasably locking the lid on the container. For certain applications, it is to be understood that only one resiliently biased locking member is required.

The details of the construction of the lid 1 are illustrated in FIGS. 1 and 6 wherein it will be seen that the lid comprises an inverted U-shaped rim having a top wall 1*a*, an outer wall 1*b* forming a skirt portion, and inner wall 1*c* integrally connected at its lower end to a shoulder portion 1*d* upon which the locking member pivot connections 5 and 6 are mounted. The shoulder portion 1*d* is provided with a depending, integral annular wall portion 1*e* which terminates at its lower end with an annular horizontal surface 1*f*. The inner peripheral edge of the annular horizontal surface 1*f* is provided with an inclined, peripheral wall 1*g* terminating at its lower end with a flat wall 1*h*. A plurality of circumferentially spaced, radially extending gusset walls 1*i* are integrally connected between the lid inner wall 1*c*, shoulder portion 1*d* and annular wall portion 1*e* to reinforce the lid. The gusset walls 1*i* are spaced so that each locking member 3 and 4 is positioned between a pair of gusset walls having their inner ends interconnected by an annular wall 1*j*, to thereby protect the locking members 3 and 4 from any damage which might be caused when the closed containers are stacked on upon the other as shown in phantom in FIG. 7. The diametrical distance between the opposed annular walls 1*j*, and between the inner ends of gusset walls 1*i*, is such to accommodate and provide stable socketing for the tapered lower end portion of a stacked container.

The details of the construction of the locking members 3 and 4 are illustrated in FIGS. 4 and 5 wherein it will be seen that each locking member includes a lever arm 3*a*, 4*a* offset from their respective pivot connections 5 and 6 and extending in a direction toward the container teeth 7. The lever arms 3*a* and 4*a* are parallel to each other and include substantially arcuate or elliptical spring members 3*b* and 4*b* which are adapted to engage a portion of the annular wall 1*j* and a diagonal wall 1*k* extending between the annular wall 1*j* and one of the radially extending gusset walls 1*i*, to thereby bias the lever arms 3*a* and 4*a* in a locking direction toward, and into locking engagement with the container teeth 7. The elliptical spring members 3*b* and 4*b* are preferably molded of plastics material integral with the locking members 3 and 4. By the engagement of the respective springs 3*b* and 4*b* at the two points, one on the annular wall 1*j* and the other on the diagonal wall 1*k*, when the locking members 3 and 4 are actuated toward the unlocking direction, a continuous biasing memory is provided on the locking member, and long-lasting memory is provided for the elliptical spring members 3*b* and 4*b*.

Each of the locking members 3 and 4 is also provided with a thumb engaging portion 3*c* and 4*c* integrally connected to the respective lever arms 3a and 4a and positioned on the opposite side of the pivotal connections 5 and 6, and offset to the opposite side of the pivotal connections 5 and 6 from the lever arms 3a and 4a. By this construction and arrangement, when the thumb engaging portions 3c and 4c are pushed to move the lever arms 3a and 4a in a counter-clockwise direction, the free end of the lever arms 3a and 4a are moved from locking engagement with the container teeth 7. The inner wall 1c of the lid in the vicinity of each locking member 3 and 4 is provided with a pair of openings or cut-outs 11 and 1m for accommodating the movement of the lever arms 3a and 4a toward and away from the container teeth 7, and the corresponding movement of the thumb engaging portions 3c and 4c. The offset lever arms 3a, 4a and offset thumb engaging portion 3c, 4c, on opposite sides of the pivot connection 5, 6, are substantially parallel to each other, and each lie closely adjacent to the inner wall 1c of the lid, and the longitudinal axis of each is disposed at acute angles to the inner wall 1c and the circumference of the lid, and at acute angles to the radii of the lid passing through the pivot connection 5, 6. Since the locking members 3 and 4 are so close to the inner wall 1c of the lid, the diameter of the bottom of the container 2 is not unduly restricted for stacking on top of the lid between gusset walls 1i and annular walls 1j. The two cut-outs 11 and 1m allow the locking members 3 and 4 to be positioned as closely as possible to the inner wall 1c of the lid.

Referring to FIGS. 6 and 7, an arrangement is illustrated for sealingly securing the lid 1 to the container 2 which comprises a buttress thread 1n provided on the inner surface of the lid outer wall 1b which cooperates with a similar interrupted thread 2a on the outer peripheral surface of the upper end portion of the container 2, whereby the lid 1 is threadably secured to the container 2.

The upper end portion of the container 2 is of double wall construction having an inner wall 2b and an outer wall 2c interconnected by reinforcing web members 2d. The upper end portions of the inner and outer container walls 2b and 2c are interconnected by an inclined wall 2e, which is adapted to be engaged by a depending lip 1o provided beneath the lid shoulder portion 1d and positioned radially outwardly of a slightly sloped annular wall 1p forming a plug portion depending from the bottom surface 1f of the lid.

By this construction and arrangement, when the lid 1 is threaded onto the container 2, as shown in FIG. 7, the lip 1o moves into sliding and sealing contact with the inclined wall 2e of the container, and simultaneously, the slightly sloping wall 1p of the plug portion moves into sliding sealing contact with the inner surface of the container inner wall 2b. This provides an outward force on the top portion of the container 2, which cooperates with the rigidizing or reinforcing effect that the container outer wall 2c and reinforcing web members 2d, and the engagement of the threads 1n and 2a have on the upper portion of the container to provide an inward restraining force, to thereby provide a very rigid, non-flexible connection at the top of the container, to thereby prevent the lid from popping off the container when dropped, which often happens with containers having a flexible top edge portion.

While the seal arrangement of FIGS. 6 and 7 is employed for sealing granular or powdery material in the container, while providing some breathing for the material in the container, the seal arrangement shown in FIG. 8 can be employed for sealing liquid in the container. In this arrangement, an annular compressible sealing ring 8 is mounted within a groove 1q provided in the lower surface of the lid between the sealing lip 1o and the annular wall 1p and adapted to engage and compress against the inclined wall 2e, when sealing lip 1o moves into sliding and sealing contact with inclined wall 2e.

Figure 9:
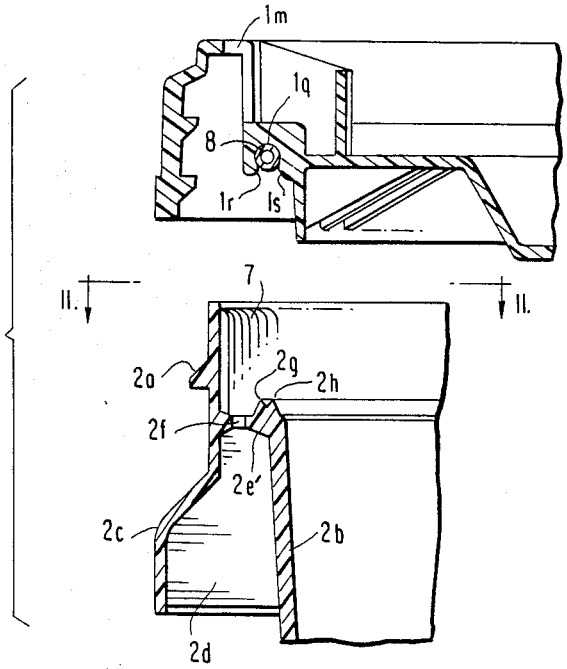
FIG. 9 is an exploded, fragmentary, sectional, side elevational view of the lid and container of the present invention employing yet another embodiment of a seal arrangement.
Figure 10:
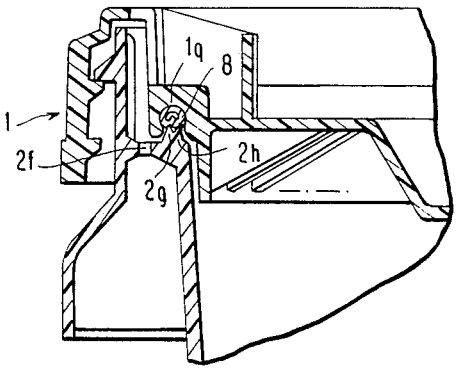
FIG. 10 is a fragmentary, sectional, side elevational view showing the lid of FIG. 9 secured to the container.
Figure 11:
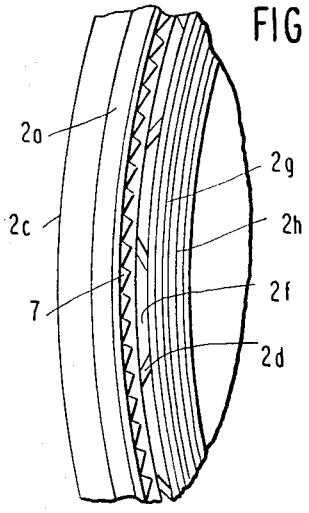
FIG. 11 is a view taken along line 11—11 of FIG. 9.

FIGS. 9 and 10 illustrate another sealing arrangement wherein an arcuate drain hole 2f is provided in the transverse wall 2e of the container in the vicinity of the cut-out portions 1l and 1m of the lid to allow any liquid such as rain water, which might otherwise accumulate within the space defined by the gusset walls 1i and annular wall 1j, to drain through the cut-out portions and away from the container through the drain hole 2f.

The upper surface of the transverse wall 2e at the top of inner wall 2l is provided with a pair of upwardly extending spaced, annular lips 2g and 2h positioned radially inwardly of the annular hole 2f and adapted to be engaged by the lid sealing ring 8 when the lid is threadably secured to the container as shown in FIG. 10. The lid sealing ring 8 is compressed by the two lips 2g and 2h and a portion of the sealing ring 8 extends into the groove formed in the space between the two lips 2g and 2h to provide a liquid-tight seal for the container.

Figure 12:
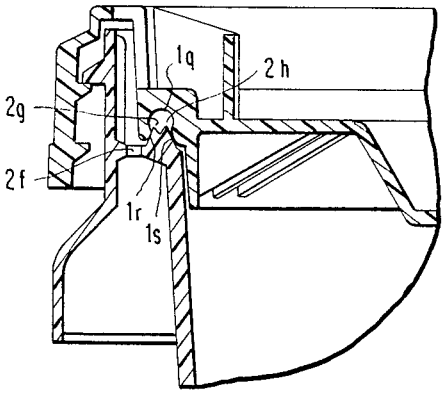
FIG. 12 is a fragmentary, sectional, side elevational view of the lid secured to the container and employing still another embodiment of a seal arrangement.

FIG. 12 illustrates yet another embodiment of the sealing arrangement of FIGS. 9 and 10 wherein the sealing ring 8 of FIGS. 9 and 10 has been removed.

The lid groove 1q from which the sealing ring 8 has been removed has outer peripheral edges 1r and 1s which slightly restrict the opening of groove 1q, and act to retain the sealing ring 8 in the groove 1q, when the sealing ring is used. The annular lips 2g and 2h have sloping side walls so the cross-section thereof is M-shaped. With sealing ring 8 removed, as the lid is threaded onto the container and tightened down, the sloping side walls of the annular lips 2g and 2h move into camming contact with peripheral edges 1r and 1s, respectively, as the lips 2g and 2h enter lid groove 1q. This provides a seal for material that must be able to breath somewhat, and a seal through which no water can enter into the material in the container when it is opened, even if the container has been left out in the open exposed to the weather, where rain water could accumulate on the lid.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. In combination; a child-resistant molded plastic container lid and an open head container, said lid having an annular inverted U-shaped rim including a top wall, an outer wall and an inner wall, and configured to fit over and receive the upper peripheral edge of said container, said lid rim containing thread portions, said container having thread portions about its outer upper periphery for mating with said threaded portions of said lid, locking teeth provided on the inner peripheral surface of the upper end portion of the container, at least one locking member, means pivotally connecting said locking member to the lid in proximity to the rim thereof, wall portion means on said lid in proximity to said locking member, said locking member including a lever arm offset from said pivot connection means and extending in a direction toward the container teeth, a thumb engaging portion integrally connected to said lever arm and positioned on the opposite side of the pivot connection means, spring means mounted between the lever arm and wall portion means on the lid for biasing the lever arm in a direction for engaging the teeth, and an opening provided in the inner wall of said lid rim in the vicinity of said locking member for accommodating the movement of the lever arm toward and away from the container teeth and another opening provided in the inner wall of said lid rim for accommodating the corresponding movement of the thumb engaging portion, whereby when the lid is threaded down upon said container to a closed position, the lever arm is biased to a locking engagement with the teeth, to thereby prevent rotation of the lid in the opposite direction to an open position by a child.

2. The apparatus according to claim 1, wherein the spring means comprises an arcuate member integrally connected to the lever arm, and engageable at two points with the wall portion means of the lid, to thereby provide a continuous biasing memory on the lever arm.

3. The apparatus according to claim 2, wherein the arcuate member is substantially elliptical.

4. The apparatus according to claim 2, wherein the wall portion means on the lid comprise a pair of circumferentially spaced, radially inwardly extending gusset walls integrally connected to the inner wall of the lid rim, said locking member being positioned within the space between said gusset walls, an annular wall connected to the inner ends of said gusset walls, whereby the locking member is surrounded and thereby protected from any damage which might be caused when the closed containers are stacked one upon the other, and a diagonal wall extending between the annular wall and one of the gusset walls, the arcuate spring being engageable with the arcuate wall and the diagonal wall.

5. The apparatus according to claim 1, wherein another locking member is pivotally connected to the lid diametrically opposite the first mentioned locking member, said second locking member including a tooth engaging lever arm extending in a direction opposite to that of the lever arm in the first mentioned locking member, said lever arms being parallel to each other.

6. The apparatus according to claim 5, wherein a pair of circumferentially spaced, radially inwardly extending gusset walls are integrally connected to the inner wall of the lid rim in the vicinity of each locking member, each locking member being positioned in the space between a respective pair of gusset walls, and an annular wall connected to the inner ends of each pair of said gusset walls, whereby each locking member is surrounded and thereby protected from any damage which might be caused when the closed containers are stacked one upon the other, the diametrical distance between the annular walls on opposite sides of the rim being such to accommodate the lower end portion of a stacked container.

7. The apparatus according to claim 1, wherein the spring means comprises an arcuate member integrally connected to said lever arm.

8. The apparatus according to claim 1, wherein the spring means comprises a substantially elliptical member integrally connected to said lever arm.

9. The apparatus according to claim 1, wherein the spring means comprises a substantially arcuate spring means.

10. The apparatus according to claim 1, wherein the spring means comprises an arcuate member integrally connected to the lever arm, and engageable at at least one point with the wall portion means of the lid, to thereby provide a continuous biasing memory on the lever arm.

11. The apparatus according to claim 1, wherein the wall portion means on the lid comprises a pair of circumferentially spaced, substantially radially inwardly extending gusset walls integrally connected to the inner wall of the lid rim, said locking member being positioned within the space between said gusset walls, an annular wall connected to the inner ends of said gusset walls, whereby the locking member is surrounded and thereby protected from any damage which might be caused when the closed containers are stacked one upon the other.

12. The apparatus according to claim 1, wherein the wall portion means on the lid comprises an annular wall integrally connected to the lid spaced radially inwardly from the inner wall of the lid rim, said locking member being positioned within the space between said annular wall and the inner wall of the lid rim, whereby the locking member is protected from any damage which might be caused when the closed containers are stacked one upon the other.

13. The apparatus according to claim 12, wherein the spring means comprises an arcuate member integrally connected to the lever arm and engageable with said annular wall on the lid.

14. The apparatus according to claim 2, wherein the wall portion means on the lid comprise a pair of circumferentially spaced, radially inwardly extending gusset walls integrally connected to the inner wall of the lid rim, said locking member being positioned within the space between said gusset walls, an annular wall connected to the inner ends of said gusset walls, whereby the locking member is surrounded and thereby protected from any damage which might be caused when the closed containers are stacked one upon the other, and the arcuate spring being engageable with the arcuate wall.

15. The apparatus according to claim 1, in which said thumb engaging portion is offset from said pivot connection means on the opposite side of said pivot connection means from said lever arm.

16. The apparatus according to claim 1, in which said thumb engaging portion and said lever arm each have a longitudinal axis, and the longitudinal axis of said thumb engaging portion being substantially parallel with the longitudinal axis of said lever arm.

17. In combination, a molded plastic container lid and an open head container, said lid having an annular inverted U-shaped rim including a top wall, an outer wall and an inner wall, and configured to fit over and receive the upper peripheral edge of said container, said lid rim containing thread portions, said container having thread portions about its outer upper periphery for mating with the threaded portions of said lid, the upper end portion of the container being of spaced double wall construction having an inner wall and an outer wall, an inclined wall interconnecting the upper end portions of the inner and outer walls, a depending lip provided on the bottom surface of the lid having a tip portion adapted for line contact engagement with the inclined wall at a medial portion thereof, and a slightly downwardly and inwardly sloped annular wall forming a plug portion depending from the bottom surface of the lid and positioned radially inwardly of the lip, whereby when the lid is threaded onto the container, the tip portion of said lip moves axially of said container into rotary sliding line contact and sealing contact with the medial portion of said inclined wall of the container, while the plug portion moves into rotary sliding sealing contact with the inner surface of the container inner wall.

18. The apparatus according to claim 17, wherein an annular groove is provided in the bottom surface of the lid between the sealing lip and the annular wall, and a sealing ring mounted within the groove, whereby the lip and sealing ring engage the inclined wall of the container when the lid is threadably mounted thereon.

19. The apparatus according to claim 17, wherein the inner and outer walls of the container are interconnected by reinforcing web members.

20. In combination, a molded plastic container lid and an open head container, said lid having an annular inverted U-shaped rim including a top wall, an outer wall and an inner wall, and configured to fit over and receive the upper peripheral edge of said container, said lid rim containing thread portions, said container having thread portions about its outer upper periphery for mating with the threaded portions of said lid, the upper end portion of the container being of spaced double wall construction having an inner wall and an outer wall, a transverse wall interconnecting the upper end portions of the inner and outer walls; a pair of upwardly extending closely adjacent annular lips provided on the container transverse wall adjacent the top of said inner wall, an annular groove on the bottom surface of said lid having downwardly diverging spaced peripheral edges, said pair of annular lips having opposed upwardly converging side edges adapted to sealingly and cammingly engage said diverging spaced peripheral edges on the bottom surface of the lid when the lid is threadably mounted on the container.

21. The apparatus according to claim 20, wherein a sealing ring is mounted in the annular groove and is adapted to be engaged by the pair of annular lips.

22. The apparatus according to claim 20, wherein drain opening means is provided in the container transverse wall communicating with the space between the inner and outer walls of the container.

23. The apparatus according to claim 20, wherein the inner and outer walls of the container are interconnected by reinforcing web members.

24. In combination; a child-resistant molded plastic container lid and an open head container, said lid having an annular inverted U-shaped rim including a top wall, an outer wall and an inner wall, and configured to fit over and receive the upper peripheral edge of said container, said lid rim containing thread portions, said container having thread portions about its outer upper periphery for mating with said threaded portions of said lid, locking teeth provided on the inner peripheral surface of the upper end portion of the container, at least one locking member, means pivotally connecting said locking member to the lid in proximity to the rim thereof, wall portion means on said lid in proximity to said locking member and spaced inwardly from the inner wall of the rim, said locking member including a lever arm offset from said pivot connection means and extending in a direction toward the container teeth, a thumb engaging portion integrally connected to said lever arm and positioned on the opposite side of the pivot connection means, spring means mounted between the lever arm and wall portion means on the lid for biasing the lever arm in a direction for engaging the teeth, and an opening provided in the inner wall of said lid rim in the vicinity of said locking member for accommodating the movement of the lever arm toward and away from the container teeth, said lever arm having a longitudinal axis, said thumb engaging portion having a longitudinal axis offset on the opposite side of said pivot connection means from the longitudinal axis of said lever arm in spaced substantially parallel relation, whereby when the lid is threaded down upon said container to a closed position, the lever arm is biased to a locking engagement with the teeth, to thereby prevent rotation of the lid in the opposite direction to an open position by a child.

25. The apparatus according to claim 24, in which the longitudinal axis of said thumb engaging portion and the longitudinal axis of said lever arm are disposed at acute substantially similar angles to said inner wall of said lid rim.

26. The apparatus according to claim 24, including another opening in said inner wall of said lid rim adjacent said thumb engaging portion for accommodating the corresponding movement of the thumb engaging portion, whereby said locking member is positioned closely adjacent said inner wall.

* * * * *